US011105150B2

(12) United States Patent
Lai

(10) Patent No.: US 11,105,150 B2
(45) Date of Patent: Aug. 31, 2021

(54) WINDING STRUCTURE FOR CORDLESS WINDOW COVERING

(71) Applicant: Chien-Feng Lai, Yuanlin (TW)

(72) Inventor: Chien-Chih Lai, Yuanlin (TW)

(73) Assignee: Chien-Feng Lai, Yuanlin (TW)

( * ) Notice: Subject to any disclaimer, the term of this patent is extended or adjusted under 35 U.S.C. 154(b) by 315 days.

(21) Appl. No.: 16/274,334

(22) Filed: Feb. 13, 2019

(65) Prior Publication Data

US 2020/0256124 A1 Aug. 13, 2020

(51) Int. Cl.
*E06B 9/78* (2006.01)
*E06B 9/44* (2006.01)

(52) U.S. Cl.
CPC . *E06B 9/78* (2013.01); *E06B 9/44* (2013.01)

(58) Field of Classification Search
CPC ..... E06B 9/78; E06B 9/44; E06B 9/40; E06B 9/56; E06B 9/60; E06B 9/42; E06B 9/50
See application file for complete search history.

(56) References Cited

U.S. PATENT DOCUMENTS 5,271,446 A * 12/1993 Hwang ..... B60J 1/2033 160/120
7,380,582 B1 * 6/2008 Anderson ..... E06B 9/34 160/323.1
2004/0182522 A1 * 9/2004 Strand ..... E06B 9/60 160/84.05
2009/0283226 A1 * 11/2009 Cheng ..... E06B 9/60 160/313
2011/0209837 A1 * 9/2011 Wieczorek ..... B60J 1/2013 160/314
2015/0368966 A1 * 12/2015 Faller ..... E06B 9/34 160/311
2018/0080278 A1 * 3/2018 Huang ..... E06B 9/60
2018/0106100 A1 * 4/2018 Foley ..... E06B 9/68

* cited by examiner

*Primary Examiner* — Daniel P Cahn
*Assistant Examiner* — Matthew R. Shepherd
(74) *Attorney, Agent, or Firm* — Alan D. Kamrath; Karin L. Williams; Mayer & Williams PC

(57) ABSTRACT

A winding structure includes two automatic winding mechanisms each including a side plate, a rotary member and an elastic member. The rotary member is provided with a receiving space, a through hole and a first fitting portion. The elastic member is mounted in the receiving space and is disposed at a one way helical state. The elastic member is provided with a clamping portion secured on the side plate and a second fitting portion secured on the first fitting portion of the rotary member. The side plate is provided with an extending portion extending through the through hole of the rotary member. The rotary member is rotated on the extending portion of the side plate and is returned to an original position automatically by the restoring force of the elastic member.

13 Claims, 5 Drawing Sheets

WINDING STRUCTURE FOR CORDLESS WINDOW COVERING

BACKGROUND OF THE INVENTION

1. Field of the Invention

The present invention relates to a window covering and, more particularly, to a winding structure for a cordless window covering, such as a roller shade, a curtain, a blind or the like.

2. Description of the Related Art

A conventional roller shade is controlled by a pull cord. When one end of the pull cord is pulled, the roller shade is extended downward, and when the other end of the pull cord is pulled, the roller shade is wound upward. Another conventional roller shade comprises a return mechanism. When the roller shade is pulled downward to a determined position, the return mechanism stores a restoring force, and when the roller shade is wound upward, the roller shade is rolled quickly by the restoring force of the return mechanism. A conventional cordless roller shade comprises a winding mechanism having a shaft and a shade cloth having an upper end secured to the shaft of the winding mechanism. When the winding mechanism is operated, the shaft of the winding mechanism is rotated to move the shade cloth upward or downward so as to wind or unwind the shade cloth. Thus, the shade cloth is wound or unwound by operation of the winding mechanism without needing a pull cord so that the conventional roller shade is operated safely and conveniently. The winding mechanism includes a bidirectional helical spring. A weight is mounted on the lower end of the shade cloth. The bidirectional helical spring and the weight form a balance state. However, the bidirectional helical spring needs a larger space of assembly, thereby increasing the volume of the winding mechanism, and increasing the cost of production.

BRIEF SUMMARY OF THE INVENTION

The primary objective of the present invention is to provide a winding structure that has an automatically winding function.

In accordance with the present invention, there is provided a winding structure comprising two automatic winding mechanisms. Each of the two automatic winding mechanisms includes a side plate, a rotary member and an elastic member. The side plate is provided with an extending portion. The extending portion of the side plate is provided with a clamping slit. The rotary member is provided with a receiving space, a through hole and a first fitting portion. The elastic member is mounted in the receiving space of the rotary member and is disposed at a one way helical state. The elastic member is provided with a clamping portion and a second fitting portion. The clamping portion of the elastic member is clamped and secured in the clamping slit of the side plate. The second fitting portion of the elastic member is fitted and secured on the first fitting portion of the rotary member. The extending portion of the side plate extends through the through hole of the rotary member, such that the rotary member is pivotally mounted on the extending portion of the side plate. The rotary member is rotated on the extending portion of the side plate and is returned to an original position automatically by a restoring force of the elastic member.

According to the primary advantage of the present invention, the elastic member is disposed at a one way helical state during the winding process, such that the winding structure has an automatically winding function.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
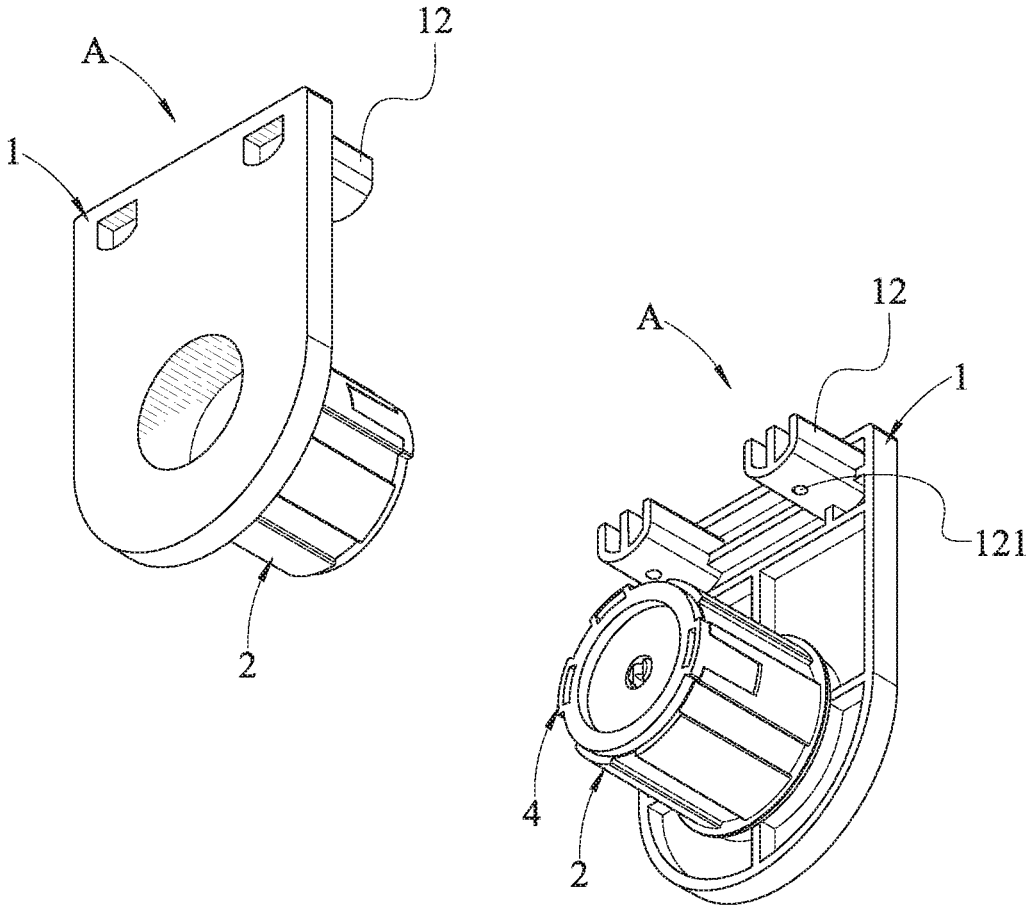
FIG. 1 is a perspective view of two automatic winding mechanisms of a winding structure in accordance with the preferred embodiment of the present invention.
Figure 2:
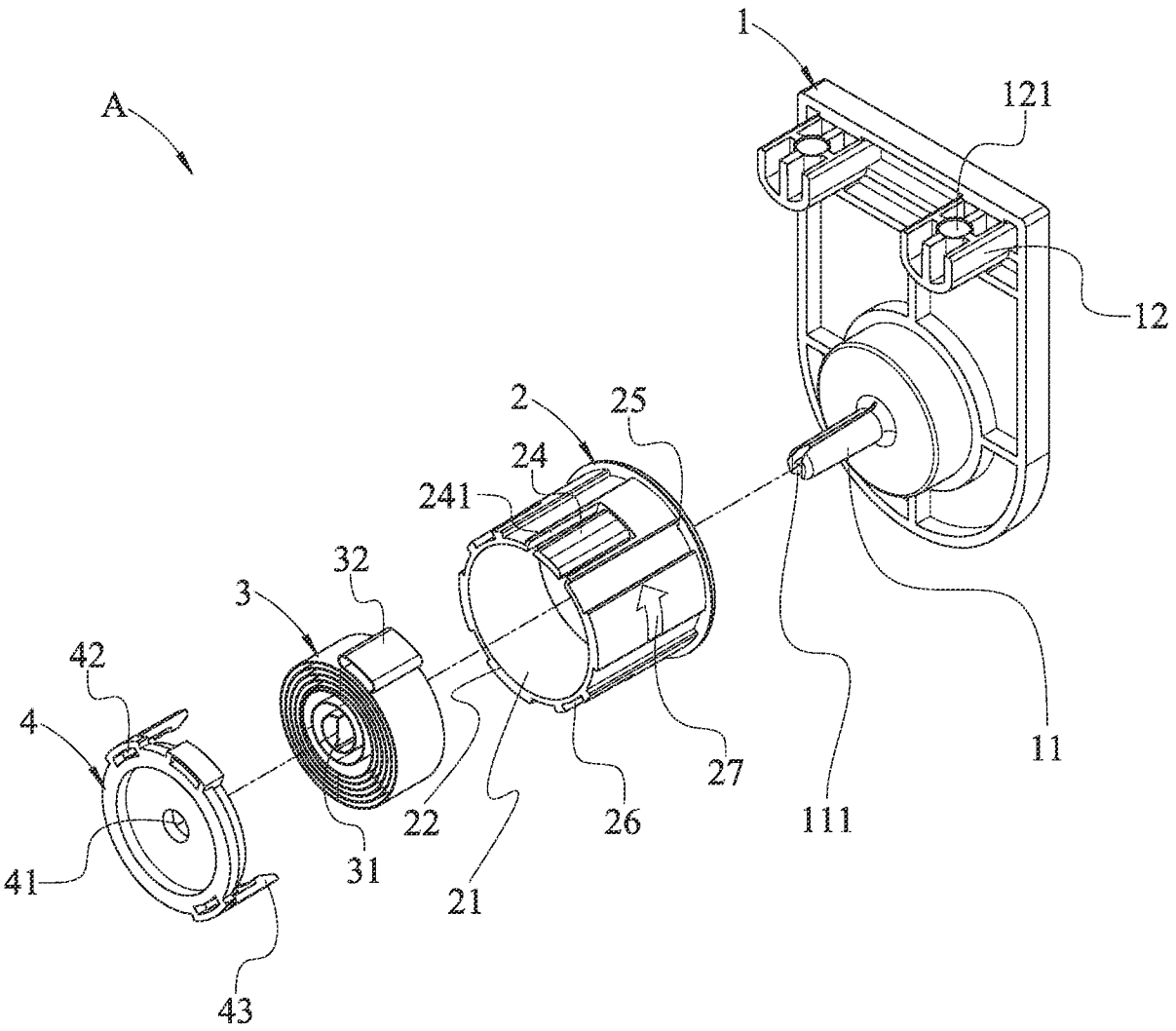
FIG. 2 is an exploded perspective view of one of the two automatic winding mechanisms in accordance with the preferred embodiment of the present invention.
Figure 3:
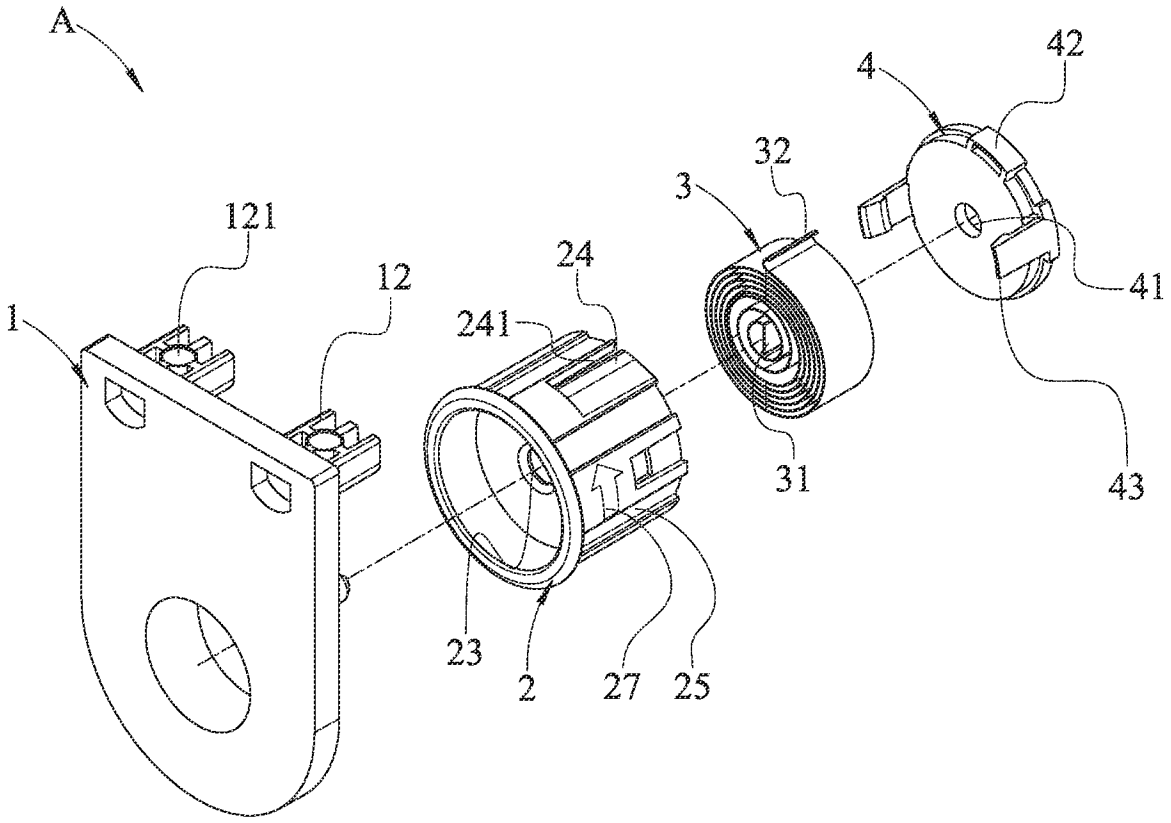
FIG. 3 is an exploded perspective view of the other one of the two automatic winding mechanisms in accordance with the preferred embodiment of the present invention.
Figure 4:
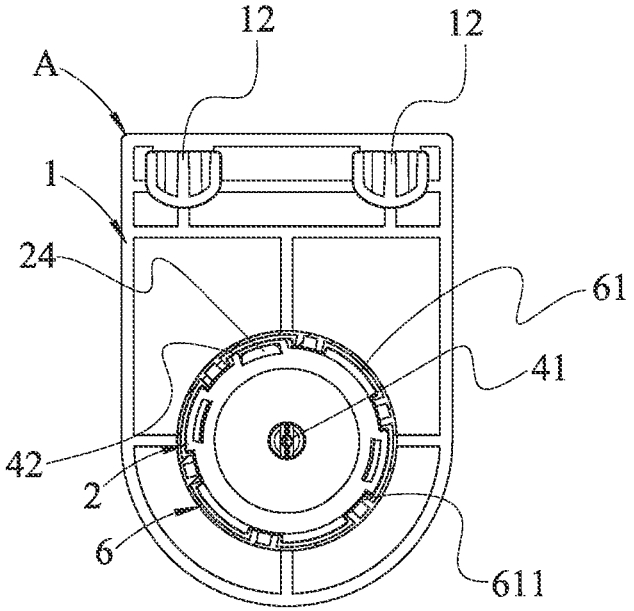
FIG. 4 is a side view of the winding structure in accordance with the preferred embodiment of the present invention.
Figure 5:
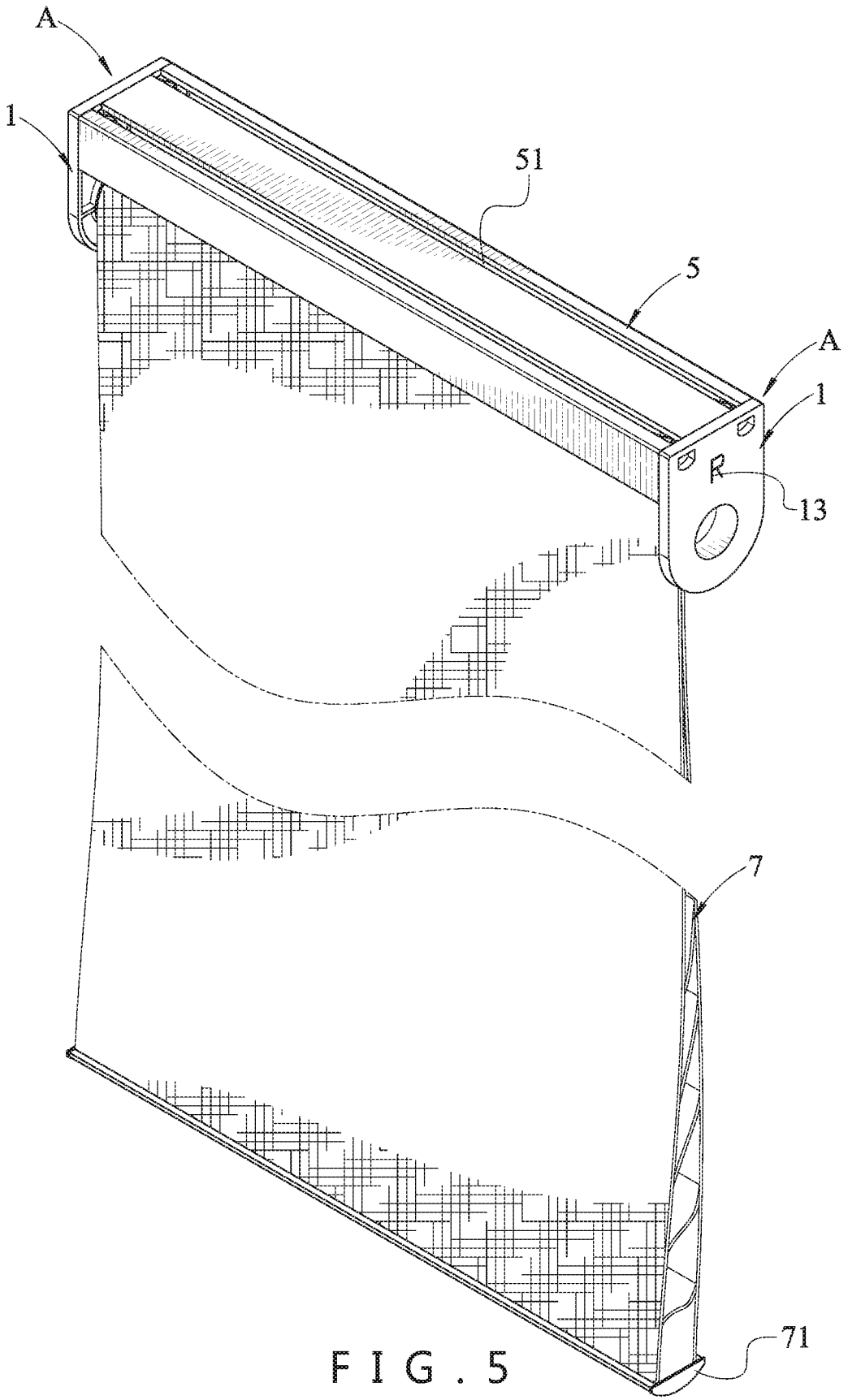
FIG. 5 is a schematic perspective view of the winding structure in accordance with the preferred embodiment of the present invention.

Referring to FIGS. 1-5, a winding structure for a cordless window covering in accordance with the preferred embodiment of the present invention comprises two automatic winding mechanisms A.

Each of the two automatic winding mechanisms A includes a side plate 1, a rotary member 2 and an elastic member 3.

The side plate 1 is provided with an extending portion (or axle) 11. The extending portion 11 of the side plate 1 is provided with a clamping slit 111.

The rotary member 2 is provided with a receiving space 21, a through hole 23 and a first fitting portion 24. The through hole 23 of the rotary member 2 is mounted on the extending portion 11 of the side plate 1.

The elastic member 3 is mounted in the receiving space 21 of the rotary member 2 and is disposed at a one way helical state. The elastic member 3 is provided with a clamping portion 31 and a second fitting portion 32. The clamping portion 31 of the elastic member 3 is clamped and secured in the clamping slit 111 of the side plate 1. The second fitting portion 32 of the elastic member 3 is fitted and secured on the first fitting portion 24 of the rotary member 2. The rotary member 2 has an elastic restoring feature by the elastic member 3.

The extending portion 11 of the side plate 1 extends through the through hole 23 of the rotary member 2, such that the rotary member 2 is pivotally mounted on the extending portion 11 of the side plate 1. Thus, the rotary member 2 is rotated on the extending portion 11 of the side plate 1 and is returned to an original position automatically by a restoring force of the elastic member 3.

In the preferred embodiment of the present invention, the winding structure further comprises a suspension seat (or headrail) 5 mounted between the two automatic winding mechanisms A. The side plate 1 is provided with at least one locking portion 12. The suspension seat 5 is provided with at least one locking channel 51 corresponding to the at least one locking portion 12 of the side plate 1, such that the suspension seat 5 and the two automatic winding mechanisms A are connected securely. The suspension seat 5 is pivotally mounted on an upper end of a window.

In the preferred embodiment of the present invention, the at least one locking portion 12 of the side plate 1 is provided with a screw hole 121, such that the at least one locking portion 12 of the side plate 1 is screwed and secured to the at least one locking channel 51 of the suspension seat 5.

In the preferred embodiment of the present invention, the receiving space 21 of the rotary member 2 has an end provided with an opening 22, and each of the two automatic winding mechanisms A further includes a cover 4 mounted on the opening 22 of the rotary member 2. The cover 4 is provided with a positioning recess 41 corresponding to the through hole 23 of the rotary member 2. The extending portion 11 of the side plate 1 extends through the positioning recess 41 of the cover 4, such that the rotary member 2 is rotated on the extending portion 11 of the side plate 1 steadily.

In the preferred embodiment of the present invention, the first fitting portion 24 of the rotary member 2 is provided with at least one slot 241, and the second fitting portion 32 of the elastic member 3 extends through the at least one slot 241 of the rotary member 2 and is hooked on the first fitting portion 24 of the rotary member 2. Preferably, the first fitting portion 24 of the rotary member 2 is provided with two slots 241 formed in two opposite sides thereof, and the second fitting portion 32 of the elastic member 3 is inserted into the two slots 241 of the rotary member 2 and fitted onto the first fitting portion 24 of the rotary member 2.

In the preferred embodiment of the present invention, the cover 4 is provided with a retaining portion (or mounting ring) 42 mounted on an end of the first fitting portion 24 of the rotary member 2, such that the second fitting portion 32 of the elastic member 3 is secured to the first fitting portion 24 of the rotary member 2.

In the preferred embodiment of the present invention, the rotary member 2 is mounted in a shaft 6. The rotary member 2 has a periphery provided with a plurality of mounting grooves 25. The shaft 6 is provided with a passage 61. The passage 61 of the shaft 6 is provided with a plurality of mounting portions 611 corresponding to the mounting grooves 25 of the rotary member 2. The rotary member 2 is inserted into and secured in the passage 61 of the shaft 6, such that the rotary member 2 is rotated in concert with the shaft 6.

In the preferred embodiment of the present invention, a shading member (or shade body) 7 is mounted on the shaft 6, and a weight member 71 is mounted on a lower end of the shading member 7. The rewinding (or restoring) force of the elastic member 3 and the weight member 71 form a balance state. Thus, after the shading member 7 is subjected to an external force, the shading member 7 is extended and can be rewound. In addition, when the shading member 7 is not subjected to an external force, the shading member 7 is disposed at a fixed state.

In the preferred embodiment of the present invention, the rotary member 2 is provided with a plurality of locking grooves 26. The cover 4 is provided with a plurality of locking ends 43 corresponding to the locking grooves 26 of the rotary member 2. When the locking ends 43 of the cover 4 is locked in the locking depressions 26 of the rotary member 2, the cover 4 covers and closes the opening 22 of the rotary member 2, such that the elastic member 3 is secured in the receiving space 21 of the rotary member 2.

In the preferred embodiment of the present invention, the side plate 1 has a side provided with a marking member 13 to distinguish a helical (or spiral or screw) direction of the elastic member 3. Preferably, the marking member 13 of the side plate 1 includes characters, figures or colors. In addition, the rotary member 2 has a surface provided with an indication member 27 to distinguish the helical direction of the elastic member 3. Preferably, the indication member 27 of the rotary member 2 includes characters, figures or colors. Thus, the two automatic winding mechanisms A are identified and assembled quickly and exactly by provision of the marking member 13 of the side plate 1 and the indication member 27 of the rotary member 2, thereby preventing the two automatic winding mechanisms A from being worn out due to a wrong direction of assembly.

Accordingly, the elastic member 3 is disposed at a one way helical state during the winding process, such that the shading member 7 is rewound automatically, and the winding structure has an automatically winding function.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A winding structure comprising:

two automatic winding mechanisms;

wherein:

each of the two automatic winding mechanisms includes a side plate, a rotary member and an elastic member;

the side plate of each of the two automatic winding mechanisms is provided with an extending portion;

the extending portion of the side plate of each of the two automatic winding mechanisms is provided with a clamping slit;

the rotary member of each of the two automatic winding mechanisms is provided with a receiving space, a through hole and a first fitting portion;

the elastic member of each of the two automatic winding mechanisms is mounted in the receiving space of the rotary member of each of the two automatic winding mechanisms and is disposed at a one way helical state;

the elastic member of each of the two automatic winding mechanisms is provided with a clamping portion and a second fitting portion;

the clamping portion of the elastic member of each of the two automatic winding mechanisms is clamped and secured in the clamping slit of the side plate of each of the two automatic winding mechanisms;

the second fitting portion of the elastic member of each of the two automatic winding mechanisms is fitted and secured on the first fitting portion of the rotary member of each of the two automatic winding mechanisms;

the extending portion of the side plate of each of the two automatic winding mechanisms extends through the through hole of the rotary member of each of the two automatic winding mechanisms, such that the rotary member of each of the two automatic winding mechanisms is pivotally mounted on the extending portion of the side plate of each of the two automatic winding mechanisms;

the rotary member of each of the two automatic winding mechanisms is rotated on the extending portion of the side plate of each of the two automatic winding mechanisms and is returned to an original position automatically by a restoring force of the elastic member of each of the two automatic winding mechanisms;

a suspension seat is mounted between the two automatic winding mechanisms;

the side plate of each of the two automatic winding mechanisms is provided with at least one locking portion;

the suspension seat is provided with at least one locking channel corresponding to the at least one locking portion of the side plate of each of the two automatic winding mechanisms, such that the suspension seat and the two automatic winding mechanisms are connected securely;

the receiving space of the rotary member of each of the two automatic winding mechanisms has an end provided with an opening;

each of the two automatic winding mechanisms further includes a cover mounted on the opening of the rotary member of each of the two automatic winding mechanisms;

the cover of each of the two automatic winding mechanisms is provided with a positioning recess corresponding to the through hole of the rotary member of each of the two automatic winding mechanisms;

the extending portion of the side plate of each of the two automatic winding mechanisms extends through the positioning recess of the cover of each of the two automatic winding mechanisms;

the first fitting portion of the rotary member of one of the two automatic winding mechanisms is provided with two slots, and the second fitting portion of the elastic member of said one of the two automatic winding mechanisms extends through the two slots of the first fitting portion of said one of the two automatic winding mechanisms and is hooked on the first fitting portion of the rotary member of said one of the two automatic winding mechanisms;

the cover of each of the two automatic winding mechanisms is provided with a retaining portion mounted on an end of the first fitting portion of the rotary member of each of the two automatic winding mechanisms, with the second fitting portion of the elastic member of each of the two automatic winding mechanisms being secured to the first fitting portion of the rotary member of each of the two automatic winding mechanisms;

the rotary member of each of the two automatic winding mechanisms is mounted in a shaft;

the rotary member of each of the two automatic winding mechanisms has a periphery provided with a plurality of mounting grooves;

the shaft is provided with a passage;

the passage of the shaft is provided with a plurality of mounting portions corresponding to the mounting grooves of the rotary member of each of the two automatic winding mechanisms;

the rotary member of each of the two automatic winding mechanisms is inserted into and secured in the passage of the shaft, such that the rotary member of each of the two automatic winding mechanisms is rotated in concert with the shaft;

the rotary member of each of the two automatic winding mechanisms is provided with a plurality of locking grooves;

the cover of each of the two automatic winding mechanisms is provided with a plurality of locking ends corresponding to the locking grooves of the rotary member of each of the two automatic winding mechanisms; and when the locking ends of the cover of each of the two automatic winding mechanisms is locked in the locking grooves of the rotary member of each of the two automatic winding mechanisms, the cover of each of the two automatic winding mechanisms covers and closes the opening of the rotary member of each of the two automatic winding mechanisms.

2. The winding structure of claim 1, wherein the at least one locking portion of the side plate of each of the two automatic winding mechanisms is provided with a screw hole, such that the at least one locking portion of the side plate of each of the two automatic winding mechanisms is screwed and secured to the at least one locking channel of the suspension seat.

3. The winding structure of claim 1, wherein:

a shading member is mounted on the shaft;

a weight member is mounted on a lower end of the shading member; and a rewinding force of the elastic member of each of the two automatic winding mechanisms and the weight member form a balance state.

4. The winding structure of claim 1, wherein the side plate of each of the two automatic winding mechanisms has a side provided with a marking member to distinguish a helical direction of the elastic member of each of the two automatic winding mechanisms.

5. The winding structure of claim 1, wherein the first fitting portion of the rotary member of each of the two automatic winding mechanisms is inserted through the second fitting portion of the elastic member of each of the two automatic winding mechanisms.

6. The winding structure of claim 1, wherein the first fitting portion of the rotary member of each of the two automatic winding mechanisms is inserted through the retaining portion of the cover of each of the two automatic winding mechanisms.

7. The winding structure of claim 1, wherein the second fitting portion of the elastic member of each of the two automatic winding mechanisms has a hollow interior.

8. The winding structure of claim 1, wherein the retaining portion of the cover of each of the two automatic winding mechanisms has a hollow interior.

9. The winding structure of claim 1, wherein the second fitting portion of the elastic member of said one of the two automatic winding mechanisms surrounds the first fitting portion of the rotary member of said one of the two automatic winding mechanisms.

10. The winding structure of claim 1, wherein the retaining portion of the cover of each of the two automatic winding mechanisms surrounds the first fitting portion of the rotary member of each of the two automatic winding mechanisms.

11. The winding structure of claim 1, wherein the retaining portion of the cover of said one of each of the two automatic winding mechanisms extends through the two slots of the first fitting portion of said one of the two automatic winding mechanisms and is hooked on the first fitting portion of the rotary member of said one of the two automatic winding mechanisms.

12. The winding structure of claim 1, wherein the second fitting portion of the elastic member of each of the two automatic winding mechanisms is positioned by the first fitting portion of the rotary member of each of the two automatic winding mechanisms.

13. The winding structure of claim 1, wherein the retaining portion of the cover of each of the two automatic winding mechanisms is positioned by the first fitting portion of the rotary member of each of the two automatic winding mechanisms.

* * * * *